United States Patent [19]

Cohen

[11] Patent Number: 4,821,349

[45] Date of Patent: Apr. 18, 1989

[54] FABRIC COVERED KNOCK-DOWN HEADBOARD FOR BEDS

[75] Inventor: Elaine S. Cohen, 222 E. 81st St., New York, N.Y. 10028

[73] Assignees: Elaine S. Cohen, N.Y.; Dale F. Beckman, N.C.

[21] Appl. No.: 145,527

[22] Filed: Jan. 18, 1988

Related U.S. Application Data

[63] Continuation-in-part of Ser. No. 18,738, Feb. 20, 1987, abandoned, which is a continuation of Ser. No. 749,732, Jun. 28, 1985, abandoned.

[51] Int. Cl.[4] ..... A47C 17/00; A47C 19/04

[52] U.S. Cl. ..... 5/53 R; 5/183

[58] Field of Search ..... 5/53 R, 183, 185, 200 R, 5/201, 280, 282 R, 285, 432, 433, 434, 437, 485

[56] References Cited

U.S. PATENT DOCUMENTS

| | | | |
|---|---|---|---|
| 674,725 | 5/1901 | Bergman et al. | 5/183 |
| 1,394,512 | 10/1921 | Tamarin et al. | 5/183 |
| 2,641,779 | 6/1953 | Gill | 5/53 R |
| 2,858,551 | 11/1958 | Sidlinger | 5/110 |
| 4,646,376 | 3/1987 | Sulley | 5/485 X |
| 4,688,281 | 8/1987 | Lantz | 5/111 |

FOREIGN PATENT DOCUMENTS

| | | | |
|---|---|---|---|
| 79921 | 1/1920 | Austria | 5/280 |
| 845415 | 8/1960 | United Kingdom | 5/280 |
| 2095986 | 10/1982 | United Kingdom | 5/53 R |

*Primary Examiner*—Gary L. Smith
*Assistant Examiner*—Michael F. Trettel
*Attorney, Agent, or Firm*—Rhodes & Coats

[57] ABSTRACT

A headboard frame includes a pair of opposed side members temporarily held together by separable center sections. The center sections are of varying length determined by whether the headboard is for twin, queen, or king size beds. A two-ply fabric cover is formed from front and rear panels slightly greater in length than the corresponding length of the headboard frame. The cover is seamed around the side and top edges. The bottom edges of the panels are initially separated to allow the cover to slide over the frame, but are then secured by hook and loop fastening strips. The cover is of such a size and so dimensioned that, when in place, the cover firmly holds the frame members together. The cover may be provided with a cushion and/or tufted front surface.

6 Claims, 3 Drawing Sheets

FIG. 3
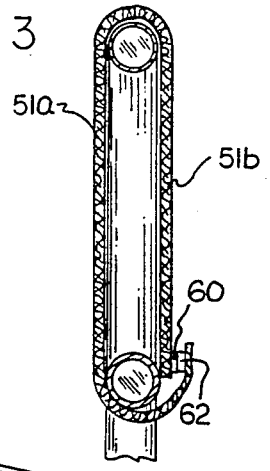
FIG. 2
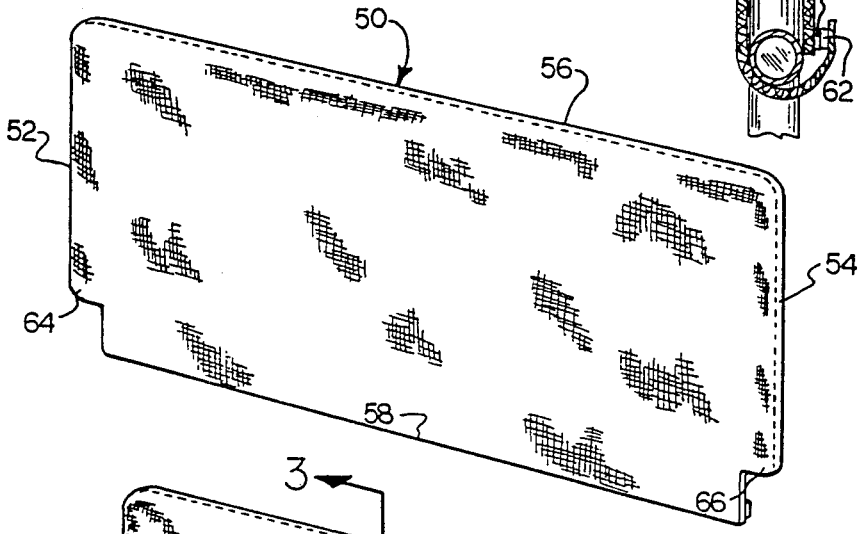
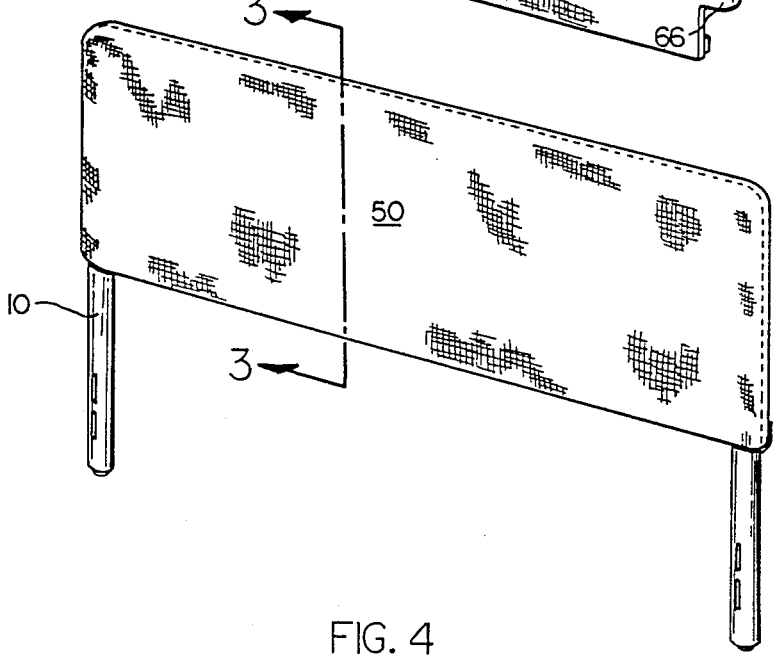
FIG. 4

FABRIC COVERED KNOCK-DOWN HEADBOARD FOR BEDS

REFERENCE TO RELATED APPLICATIONS

This application is a continuation-in-part of Ser. No. 018,738 filed Feb. 20, 1987 now abandoned, which in turn is a continuation application of Ser. No. 749,732 filed June 28, 1985, now abandoned.

BACKGROUND AND SUMMARY OF THE PRESENT INVENTION

This invention relates to headboards for beds and more particularly to a knock-down fabric covered headboard having merchandising advantages over those previously known.

In recent years, furniture designs have utilized headboards with fabric covers. Sometimes such fabric covers are cushioned, quilted, or tufted. As used herein the term "fabric" is also understood to include leather. It is customary in the manufacture and marketing of such fabric covered headboard frames to fabricate frames of a length suitable for either twin, full or queen, or king size beds, then upholster the frame to complete the fabric covered frame at the manufacturing location. Thus all three sizes are manufactured and upholstered at the manufacturing location. They must then be inventoried, shipped and stored fully assembled.

This presents substantial merchandising problems in that a retailer must anticipate the number of each size headboard for each fabric pattern that may be requested by customers. This results in either extremely large inventor or limited selections for the retailer. The alternative is to have the customer select the headboard from samples or catalogs, then order the headboard from the manufacturer. It has been found that this is not entirely satisfactory, because when a customer selects a headboard, he prefers to have immediate delivery, rather than several weeks or months delay while it is backordered. In addition, the shipping, storing, and warehousing of assembled, fabric covered headboards is expensive, because they are bulky and require substantial storage and shipping space.

In accordance with the present invention, however, there is provided a knock-down headboard frame with a separable slip cover type fabric covering therefore which holds the frame members together. All headboards utilize the same end pieces joined by separable center sections. The difference between a twin, full, queen, and king size resides solely in the lengths of the center sections used. The unit is individually cartoned. Each carton contains a right and left upright, center section, connecting plates, a fabric cover, and written instructions. Since the headboard is in collapsed configuration, the shipping and storage costs are considerably decreased. Further, the fabrication costs are minimized because of the standardized parts.

Upon purchase the customer merely assembles the appropriate center sections, (twin, full, queen, or king size) between a pair of identical side members to form a frame of the appropriate size. The appropriate cover is then slipped over the headboard frame and the lower edges thereof secured to form the finished headboard. The cover is of such a size and so dimensioned that, when in place, it is snug around the frame to hold it together, while the cover itself is slightly stretched. Thereafter, if the customer wants to clean or replace the cover, he merely removes the cover and either cleans or replaces it. Conversion of Hollywood beds to double, queen, or king size beds is made more easy. Also to change the decor of a room, it is only necessary to purchase a new cover.

In general, the frame for the present invention includes a left-hand side member and a right-hand side member which are basically the same regardless of whether the frame is to be made into a twin, full, queen, or king size headboard. Center sections are provided of five different lengths: a short length for twin size beds (approximately six inches in effective length); a second length for full size beds (approximately twenty-one inches in effective length); a third length for queen size beds (approximately twenty-seven inches in effective length); and a first longer section to be added to the queen size length to form king size frames (approximately forty-five inches in effective length); and a second longer section to be added to the queen size length to form a "California King" frame. Alternatively the king size frame may use a longer center length as a center section. The ends of the center sections include a portion of reduced diameter for insertion into the opposed tubular arms of the side members which extend toward each other. Once assembled, the side members and center sections form the headboard frame of the appropriate length. In this condition the frame is not intended for use, because it is not sufficiently sturdy until the cover is assembled as described below.

The fabric covers are formed of a pair of opposed fabric panels. The fabric panels are seamed on each end and across the top, and initially open at the bottom. When sewn the distance between the end seams is no greater than (and perhaps slightly less than) the distance between the upright tubular posts of the side members, so that the cover is stretched as it is assembled to more securely hold the frame together. The fabric panels adjacent the bottom edges are provided with a releasable attaching means, such as zippers or hook and loop fastener strips, referred to as Velcro fasteners, a trademark of Velcro U.S.A., Inc., of Manchester, NH. With these Velcro fastener strips the lower edges of the cover member may be secured together when the cover is assembled onto the frame. This results in an even more rigid connection of the frame, keeps the cover from sliding up and helps to hold the cover taut.

It is therefore an object of the present invention to provide a knock-down, fabric covered headboard.

It is another object of the present invention to provide a headboard of the type described in which the frame members and cover may be shipped and stored in a collapsed condition until ready for assembly.

Another object of the present invention is to provide a frame for headboards of the type described in which the side members thereof are essentially the same regardless of the size of the headboard, and the only difference is in the length of the center section joining the side members.

Other objects and a fuller understanding of the invention will become apparent from reading the following detailed description of the preferred embodiment along with the accompanying claims in which:

FIG. 2 is a perspective view illustrating a first type of relatively plain and simple cover which may be utilized in connection with the headboard frame of FIG. 1;

FIG. 3 is a sectional view taken substantially along line 3—3 in FIG. 2;

FIG. 4 is a perspective view illustrating the cover of FIG. 2 assembled onto the headboard frame of FIG. 1;

DETAILED DESCRIPTION OF A PREFERRED EMBODIMENT

Turning now to the drawings, there is illustrated a fabric covered, knock-down headboard according to the present invention which includes, in general, a collapsible frame 10 covered by a fabric cover (either plain cover 50 or cushioned cover 70).

Figure 1:
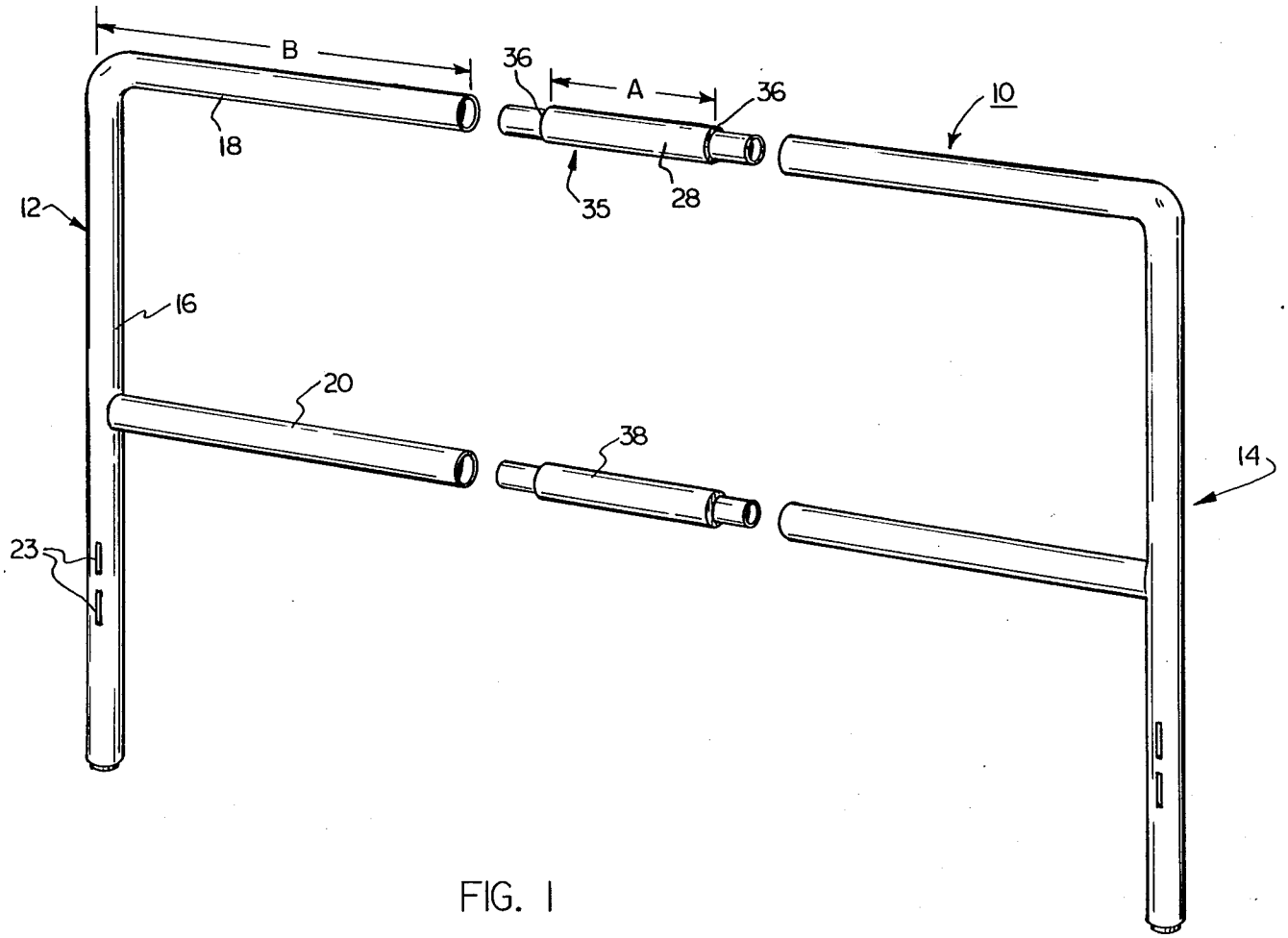
FIG. 1 is an exploded perspective view illustrating the knock-down headboard frame with cover removed according to the present invention.

The knock-down frame is best illustrated in FIG. 1 and includes a pair of opposed side members 12,14 connected by a pair of center sections 28,38. Side members 12,14 are substantially identical, therefore only side member 12 will be described in detail. An upright tubular post 16 includes a pair of tubular arms 18,20 extending at generally right angles thereto. The open bottom of tubular post 16 is provided with a domed metal or plastic glide 22 in accordance with conventional furniture construction. Each upright post 14,16 is preferably but not necessarily, provided with a pair of vertically spaced holes 15 to mount a lamp, swinging table, or the like therein, if desired. Also, conventional slots 23 are provided in the lower portion of post 16 for the attachment of conventional connecting or adapter plates which attach to the side rails of the bed frame or allow the frame to be attached to the wall. The placement of slots 23 (with arms 18,20 to the left or to the right) is the only difference between side member 12 and side member 14. The remainder of the bed frame is not shown, because it is formed in a well-known manner.

The center sections 28,38 are identical, therefore a detailed description of center section 28 will suffice. End portions 30,32 of reduced diameter extend outwardly from either end of the central body member 35 for insertion into the adjacent tubular arm 24. The reduced diameter forms a radial shoulder 36 which abutts the end of arms 18,20 to provide a means for controlling the overall length of the assembled frame. While fasteners may be used to help secure the frame, they generally are not necessary as the cover 50 holds the frame rigidly together. Center section 38 is assembled identically between arms 20 of side members 12,14.

In order for the frame to be adaptable for use as either a frame for twin, full, queen, or king size headboards, it is only necessary to change the center sections 28,38. As indicated in FIG. 1, dimension A is the effective or operable length of center sections 28,38. The length (dimension B) of arms 18,20 does not change, and is always preferably sixteen and one-fourth inches. Dimension A of the center sections 28,38 is six inches for twin size frames; twenty-one inches for full size frames; twenty-seven inches for queen size frames, and forty-five inches for king size frames. Thus, when assembled, a twin headboard will be approximately thirty-eight and one-half inches in length; a full size headboard will be approximately fifty-four inches in length; a queen size headboard will be approximately fifty-nine and one-half inches in length; and a king size headboard will be approximately seventy-seven and one-half inches in length.

Turning now to FIGS. 2–4, there is illustrated a simple fabric cover 50 which has the appearance of an inverted, U-shaped pocket member formed from front and rear fabric panels, **51*a*,51*b*. Such panels 51*a*,51*b* are folded or seamed at the top 56, as well as being seamed at the ends 52,54. The distance between seams 52,54 should not exceed the distance between the upright posts 16 of the side members 12,14 of the assembled frame. Thus the cover 50** is stretched as it is assembled to tightly hold the frame together.

The bottom 58 of cover 50 is left unseamed and initially open to slide over the frame 10, however, includes a fastening means, such as a pair of Velcro strips 60,62, on the inside front and outside rear surfaces of panels **51*a*,51*b* near the lower edge. It is pointed out here that "Velcro" type fasteners are those that include a pair of opposed fabric members, one of which members is provided with a multiplicity of tiny loops and the other being provided with a multiplicity of tiny hooks. When pressed together the strips remain secured until sufficient pressure in a direction normal to the plane of the fabric strips is exerted to pull them apart. The fabric cover 50 is assembled by slipping the pocket shaped member down over the frame 10, then pressing the Velcro strips 60,62 together beneath the lower arms 20 and lower center section 38 of frame 10. It should be noted here that the Velcro strips 60,62 do not extend the entire length of cover 50, there being a slight space 64,66 at each end through which the upright post 14,16** extends when assembled. Further Velcro is an excellent fastening means, other fastening means such as snaps, ties, and the like are also contemplated.

Figure 5:
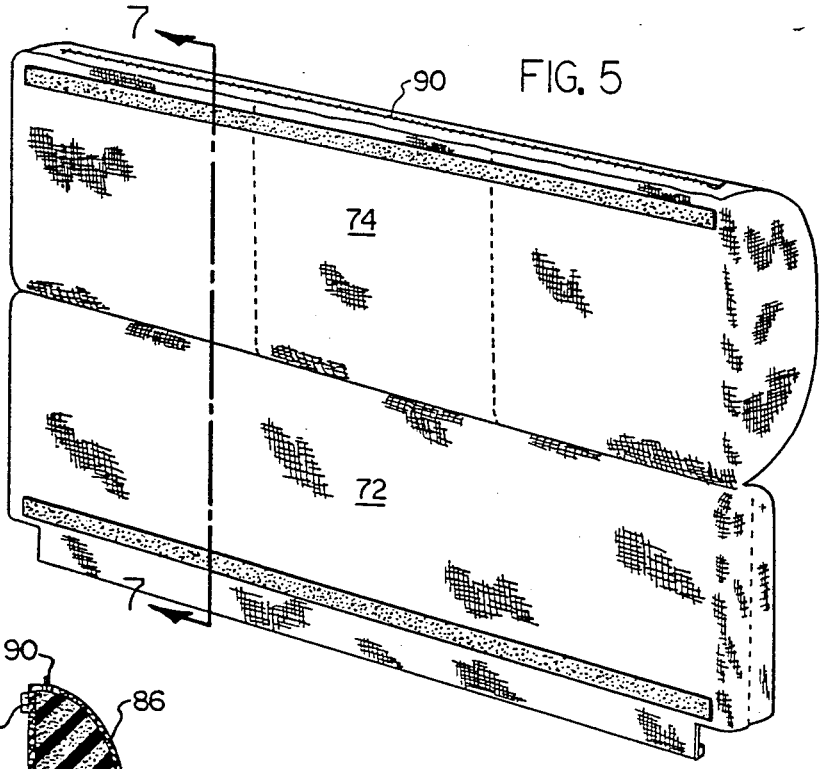
FIG. 5 is a perspective view of a second example of a cushioned type of cover.
Figure 7:
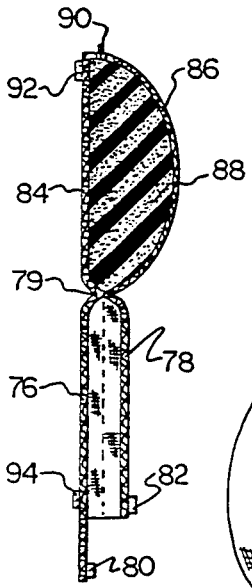
FIG. 7 is a cross-sectional view taken substantially along lines 7—7 in FIGS. 5.
Figure 6:
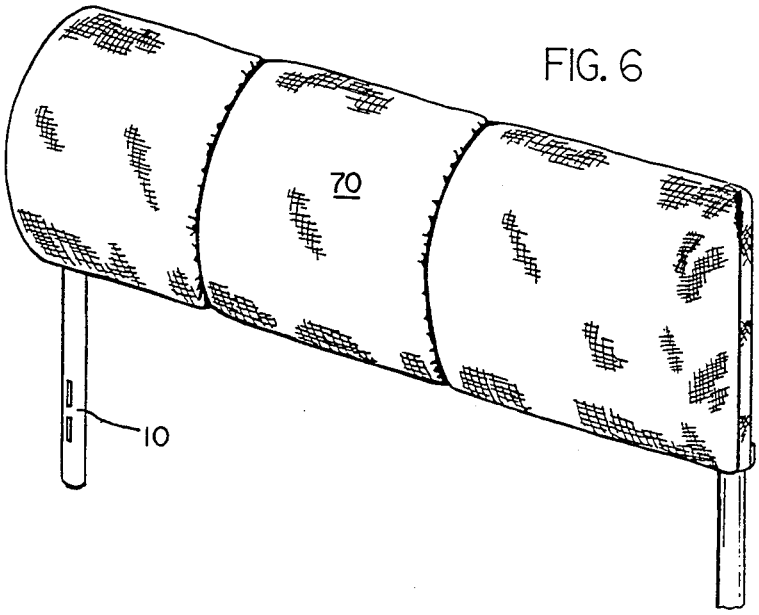
FIG. 6 is a perspective view illustrating the second type of cushioned cover mounted on the headboard frame of FIG. 1.

FIGS. 5–7 are illustrative of a second type of cover 70 which is cushioned to form a pillowed effect on the headboard. Cover 70 includes a lower inverted, U-shaped, picket portion 72 which is very similar to the cover 50 in that it is provided with a pair of opposed panels 76,78 which are folded or seamed at the top edge 79 thereof and provided with an open bottom. Again, Velcro fastening strips 80,82 are provided on the inner surface of front panel 76 and the outer surface of rear panel 78 to join the fabric panels together once the cover 70 is mounted on frame 10. An upper portion 74 is attached to the upper edge of lower portion 72 by seaming, or the like, and includes a front panel 84 and a fuller rear panel 86. Suitable stuffing material 88 is provided between the front and rear panels 84,86 respectively to form the cushioned effect. A zipper 90 selectively secures the upper opening between front and rear panels 84,86 to allow access to the interior thereof for emplacing the stuffing material therein. The stuffing material may be down, polyester filling material, polymeric foam, or any other type of conventional filling material. The upper portion of panel 84 is provided with a fastening strip 92 on the outer surface thereof. When folded down over the front panel 76 of the lower member 72, strip 92 is selectively secured to the lower fastening strip 94 on front fabric panel 76. Again strips 92,94 may be Velcro. Thus, when folded, the rear panel 86 of upper member 74 becomes the front, exposed portion of the cover 70 which provides the cushioned effect.

The fabric covers 50,70 may be provided with any type of decorative fabric pattern which may be woven, imprinted or emplaced upon the fabric cover in any other conventional manner.

While the present invention has been described in detail hereinabove, it is apparent that various changes and modifications might be made without departing from the scope of the invention which is set forth in the accompanying claims.

What is claimed is:

1. A decorative, knock-down headboard comprising:

(a) a knock-down frame including a pair of opposed side members, each side member having an upright tubular post with an upper and a lower tubular arm extending horizontally therefrom towards the corresponding upper and lower arms of the other side member, said upper arms of the opposed side members being connected, when assembled, by a first separable center section and said intermediate arms of the opposed side members being connected by a second separable center section;

(b) a cover member including a pair of opposed fabric panels having top, bottom, and end edges and a front surface, the top and end edges of said fabric panels being seamed and the bottom edges being initially open, and releasable attaching means adjacent the bottom edges of the fabric panels on either side of said open bottom for selective closure thereof;

(c) said cover member being assembled over the upper tubular arms of said frame, and said releasable attaching means being connected together around said lower tubular arms to secure the cover member thereto; and (d) the size and dimensions of said cover being such that, when assembled as set forth in subparagraph (c), said cover is tightly stretched over said frame members to retain them in assembled relation.

2. The decorative headboard according to claim 1 wherein said center sections each include a central body member which terminates in an end portion of reduced diameter, a radial shoulder connecting said central body member with said end portion, wherein said end section is inserted into the adjacent tubular arm of said side member and said shoulder limits the relative movement between said center section and said tubular arm to define the horizontal dimension of said headboard frame.

3. The decorative headboard according to claim 1 wherein said releasable attaching means along the bottom edges of the fabric panels surrounding the opening comprising a pair of mating hook and loop fastener strips.

4. The decorative headboard according to claim 1 wherein said center sections are provided in varying lengths, each of which may be selectively assembled between said opposed side members, said center section being selected from one of said plurality of lengths depending upon whether said headboard is to be utilized with a twin, full or queen, or king size headboard.

5. The decorative headboard according to claim 1 wherein said cover member further includes an upper cushioned portion formed from a second pair of fabric panels having upper and lower edges and a rear surface secured along the lower edge thereof to the top edge of said aforementioned fabric panels, the upper edges of said second pair of fabric panels being initially separated and provided with a fastening means therebetween, filling material inserted between said upper fabric panels, and means for securing the rear surface of said upper portion adjacent the upper edge thereof to the front surface of said first fabric panels adjacent the lower edge thereof when said upper fabric panels are hinged down over said lower fabric members, thereby providing a cover with a cushioned front surface.

6. A fabric cover for headboard frames of a type made from separate members comprising:

(a) a cover member including a first pair of opposed fabric panels having top, bottom, and end edges and a front surface;

(b) the top and end edges of said fabric panels being closed and the bottom edges being initially open;

(c) the bottom edges of said fabric panels surrounding said opening provided with releasable attaching means;

(d) the size and dimensions of said cover being such that, when assembled on said headboard, said cover is tightly stretched thereover to retain said separable members in assembled relation; and (e) an upper cushioned portion formed from a second pair of fabric panels having upper and lower edges and a rear surface secured along the lower edge thereof to the top edge of said aforementioned fabric panels, the upper edges of said second pair of fabric panels being initially separated and provided with fastening means therebetween, filling material inserted between said upper fabric panels, and means for securing the rear surface of said upper portion adjacent the upper edge thereof to the front surface of said first fabric panels adjacent the lower edge thereof when said upper fabric panels are hinged down over said lower fabric members thereby providing a cover with a cushioned front surface.

* * * * *